US006242070B1

(12) United States Patent
Gillispie et al.

(10) Patent No.: US 6,242,070 B1
(45) Date of Patent: Jun. 5, 2001

(54) ENERGY ABSORBING COLUMN PROTECTOR

(75) Inventors: John G. Gillispie, Glen Dale; Donald J. Mitchell, Wellsburg, both of WV (US)

(73) Assignee: Eagle Manufacturing Company, Wellsburg, WV (US)

( * ) Notice: Subject to any disclaimer, the term of this patent is extended or adjusted under 35 U.S.C. 154(b) by 0 days.

(21) Appl. No.: 09/500,511

(22) Filed: Feb. 9, 2000

(51) Int. Cl.[7] ..... B32B 3/06

(52) U.S. Cl. ..... 428/99; 428/122; 52/736.4; 52/737.5

(58) Field of Search ..... 428/99, 122; 52/732.3, 52/732.2, 732.1, 736.3, 737.4, 738.1, 736.4, 737.5; 405/216

(56) References Cited

U.S. PATENT DOCUMENTS

| | | | | |
|---|---|---|---|---|
| D. 380,274 | | 6/1997 | Stamets | D25/38 |
| 3,590,547 | * | 7/1971 | Moylneux | 52/728 |
| 3,798,867 | | 3/1974 | Starling | 52/724 |
| 4,019,301 | | 4/1977 | Fox | 52/725 |
| 4,244,156 | | 1/1981 | Watts, Jr. | 52/746 |
| 4,596,106 | | 6/1986 | Kunczynski | 52/728 |
| 5,006,386 | | 4/1991 | Menichini | 428/58 |
| 5,048,229 | | 9/1991 | Campbell | 47/24 |
| 5,311,713 | | 5/1994 | Goodrich | 52/301 |
| 5,503,371 | | 4/1996 | Bies | 256/1 |
| 5,605,414 | | 2/1997 | Fuller et al. | 404/6 |
| 5,924,262 | | 7/1999 | Fawley | 52/721.4 |
| 6,102,611 | | 8/2000 | Roller | 404/6 |

OTHER PUBLICATIONS

Sales Brochure For "Column Sentry" From Therm–All Inc. (no date).

* cited by examiner

*Primary Examiner*—Alexander S. Thomas
(74) *Attorney, Agent, or Firm*—Armstrong, Westerman, Hattori, McLeland & Naughton, LLP

(57) ABSTRACT

Molded plastic energy absorbing cushions for protecting columns in facilities such as warehouses or manufacturing plants having forklifts or other such mobile equipment moving about. A pair of cushions, positioned back-to-back surround a column at its base to protect it from colliding equipment. The cushions are hollow with corrugations on their faces to absorb impact of a collision. A cavity is configured in a back of each cushion to add impact absorbing properties.

11 Claims, 6 Drawing Sheets

ENERGY ABSORBING COLUMN PROTECTOR

BACKGROUND OF THE INVENTION

1. Field of the Invention

This invention relates to a protector for structural columns in facilities such as warehouses and manufacturing plants. The protector cushions the impact of mobile equipment such as a forklift, that might come in contact with the column. Damage to the structure and equipment, as well as injury to an operator is reduced or eliminated.

2. Description of Related Art

Many operations in warehouses and manufacturing plants require the use of forklift type equipment for handling inventory, ingredients, completed products, and the like. Operation of such equipment in facilities having structure supporting columns presents a significant safety concern. Accidental contact of an unprotected column by a forklift for example, can cause serious structural damage to the facility as well as damage to equipment and injury to personnel.

A common method to limit structure damage consists of surrounding the columns with massive amounts of poured concrete which protects the column, but does little to protect the equipment or its operator. Maintenance of the concrete to repair cracks or chips is time consuming.

U.S. Pat. No. 3,798,867 describes a method of surrounding a column with a rigid cover, then filling the space between the cover and the column with an epoxy material.

U.S. Pat. No. 4,019,301 also describes the use of an encasement sleeve of fiberglass or epoxy resin and a filler of concrete, epoxy, or the like.

U.S. Pat. No. 4,244,156 describes a tubular plastic shell having longitudinally extending interior pockets used with a foamed adhesive between a shell vertical member.

U.S. Pat. No. 5,006,386 describes sheathing sections of a resilient material having hinged channels and interlocking means so as to be formed around a column to be protected.

U.S. Pat. No. 5,605,414 describes protection of a vertical member with use of a resilient membrane incarcerated by a cover.

SUMMARY OF THE INVENTION

Two hollow molded plastic cushions each having a substantially planar back, a generally convex face, and opposed ends are positioned back-to back to completely surround a vertical column. The back of each cushion has a cavity having a cross-section, transverse to the longitudinal axis of the cushion, which generally matches the transverse cross-section of the column to enable the back-to-back placement. The face of each cushion, which would receive contact with colliding equipment, has horizontally oriented corrugations to absorb a portion of the impact. One embodiment of the protector provides spacing between the cushion and the column along a major portion of its length which allows the cushion to flex for additional impact absorption.

DETAILED DESCRIPTION OF THE INVENTION

Figure 1:
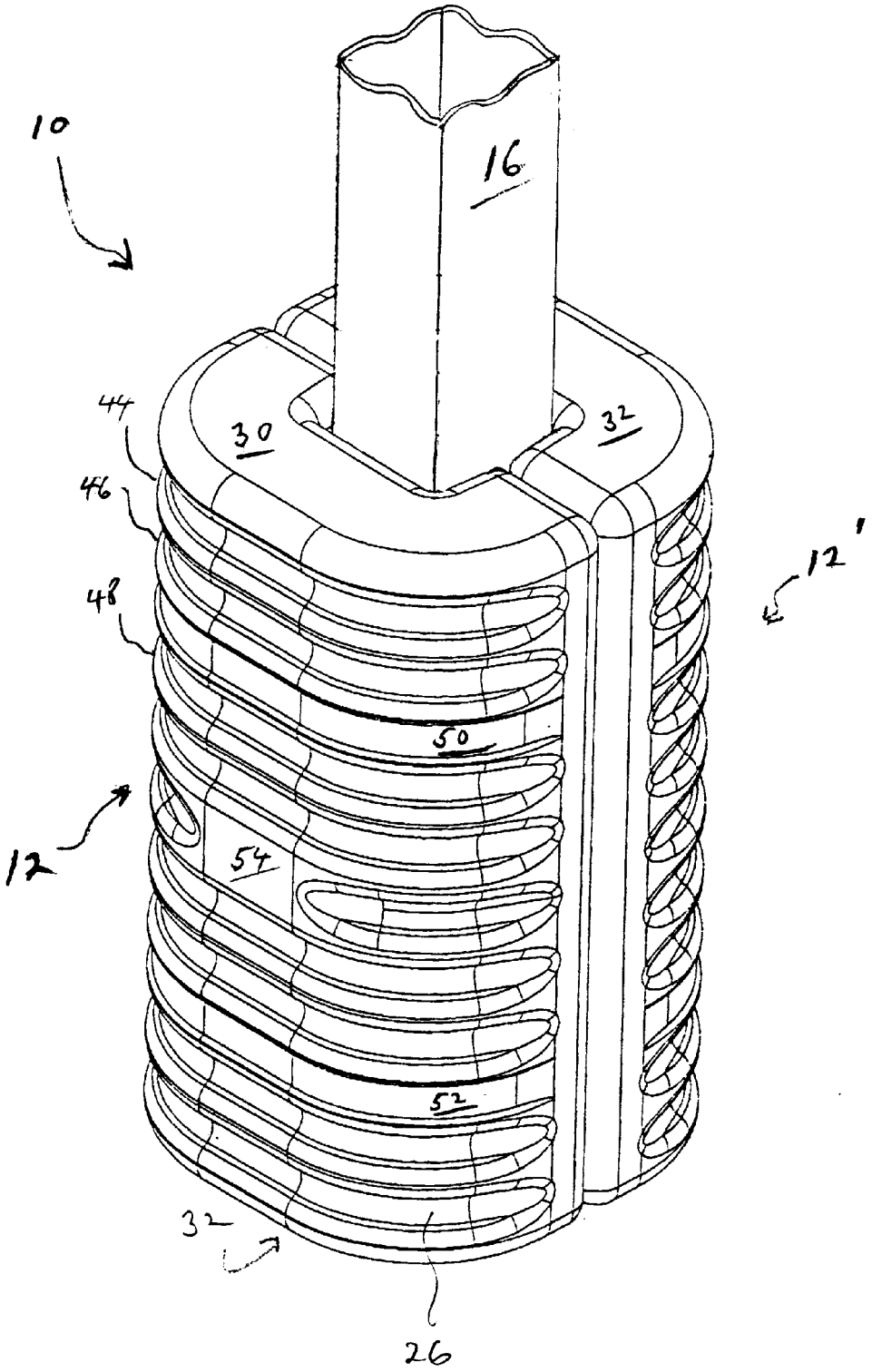
FIG. 1 is a perspective view of a column protector of the invention in place surrounding a column having a square cross-section.
Figure 2:
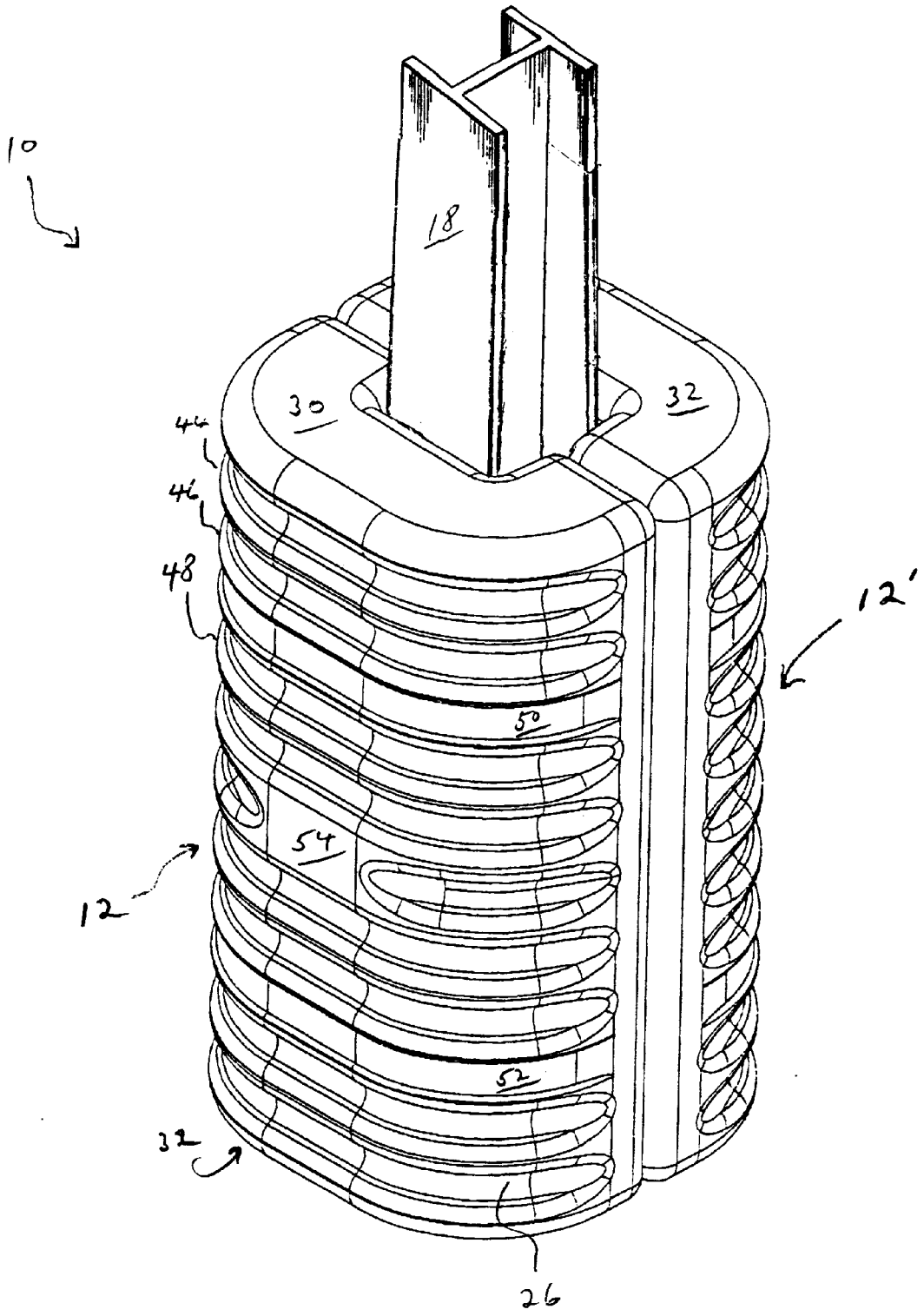
FIG. 2 is a perspective view of the column protector of FIG. 1 in place surrounding an I-beam column.
Figure 3:
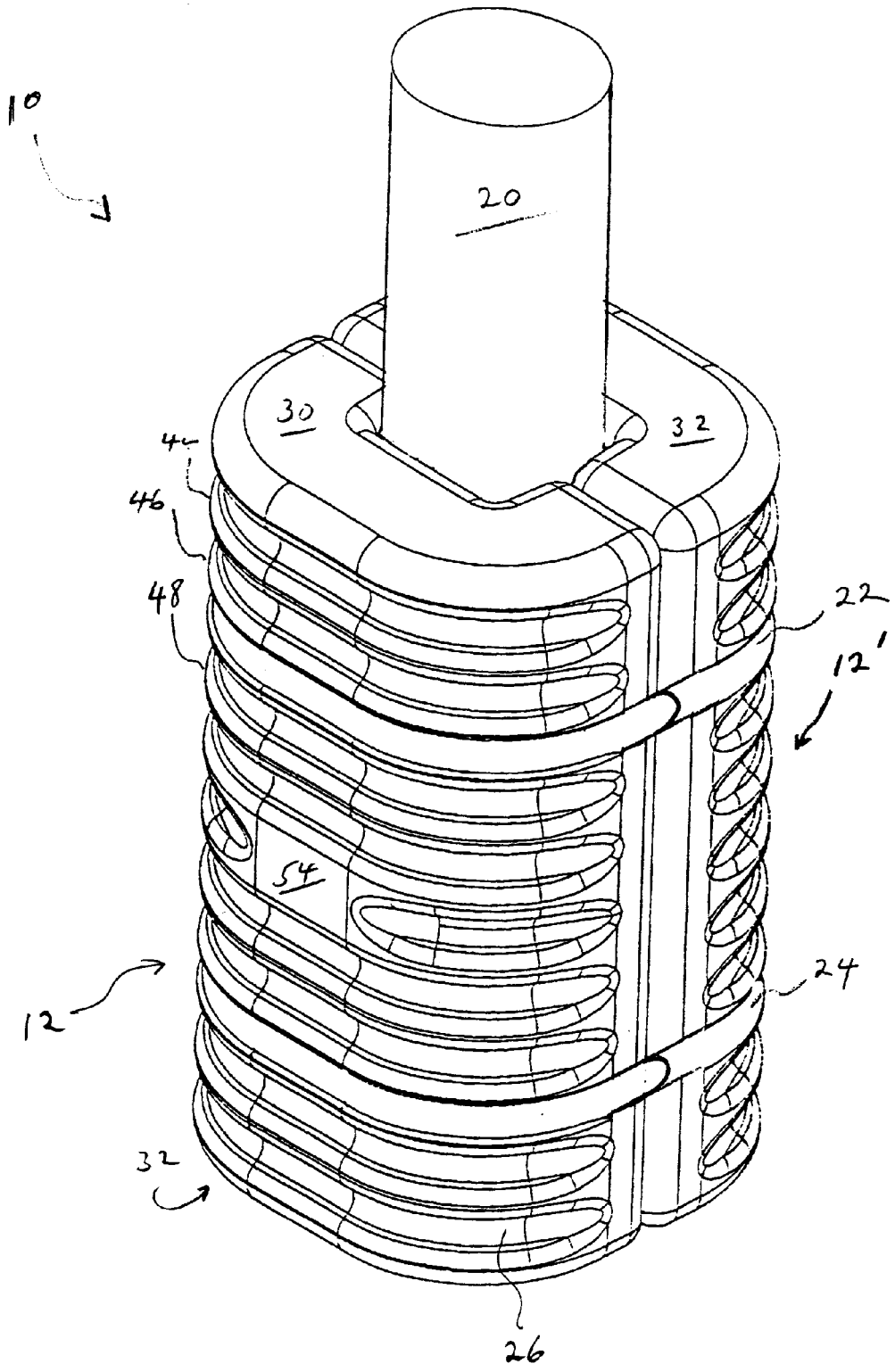
FIG. 3 is a perspective view of the column protector of FIG. 1 in place surrounding a cylindrically shaped column.

The column protector of the invention is made up of a pair of elongated cushions which are generally semi-cylindrical in shape and are placed back-to-back to surround a column to be protected. FIGS. 1–3 depict the invention in use with columns having various cross-sections.

In FIG. 1, column protector 10 is made up of cushions 12 and 12' which are a matching pair; that is each cushion is substantially identical. Column 16 is of a rectangular cross-section.

In FIG. 2, column protector 10 is surrounding column 18 which is an I-beam.

FIG. 3 shows column protector 10 surrounding column 20 which is cylindrical in shape. Also shown are belts 22 and 24 which encompass cushions 12 and 12' to hold the cushions in back-to-back placement. The belts are preferably of nylon with loop and hook type end attachments.

Figure 4:
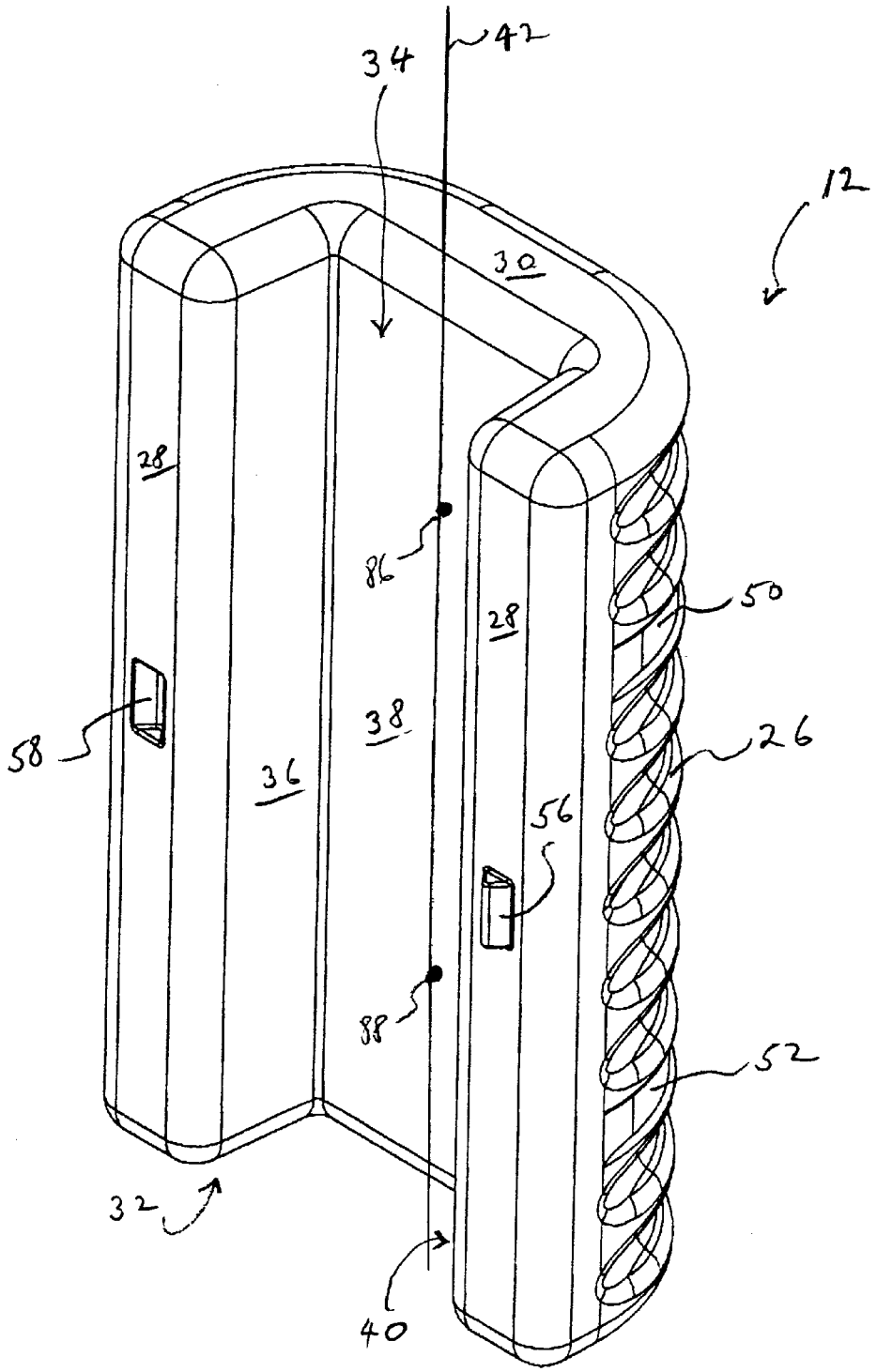
FIG. 4 is a perspective view of a cushion of a column protector of the invention having a cavity in its back presenting a constant cross-section from end to end.

Cushion 12 of the invention is shown singly in FIG. 4 to better point out its features; the views of cushion 12 found in FIGS. 1–3 are advantageous for pointing out features hidden in the FIG. 4 view. Cushion 12 is generally semi-cylindrical in shape, and is molded as a single unit. In a preferred embodiment it is hollow and blow-molded of HDPE (High Density Polyethylene) with an average wall thickness between ⅛ and ¼ inch. The various portions of the cushion are a face 26, back 28, and opposed ends 30 and 32. Face 26 is generally convex in shape, while back 28 is substantially planar. Corners where such surfaces intersect are preferably rounded. To enable back-to-back placement of a pair of cushions, back 28 has a cavity 34 formed in it which is defined by surfaces 36, 38 and 40. Such cavity has a cross-section, transverse to the longitudinal axis of the cushion, 42, which has the general shape of the cross-section of the column it is adapted to surround. Such cavity cross-section need not match the cross-section of the column exactly, for example, a column protector having a cavity with a rectangular cross-section is shown in FIGS. 2 and 3 in use with an I-beam and a cylindrically shaped column respectively.

Cushion face 26, best viewed in FIGS. 1–3, is molded to have a series of corrugations oriented in the horizontal direction. Examples of corrugation ridges are at 44, 46 and 48. Such corrugations absorb some of the impact of a collision. The depth of the corrugations (distance from peak to valley measured perpendicular to the face) in the preferred embodiment is between ½ and 1½ inches. At least one narrow, horizontally oriented portion is preferably free of corrugations such as at 50 and 52 for placement of a belt for retaining the cushions in position about the column. A small portion of face 26, such as at 54, can also be free of corrugations for locating a label, instructions, or other such purpose.

Cushion ends 30 and 32 are preferably planar to facilitate stacking of protectors when protection of a column at a height greater than the length of a single cushion is desired, however, rounded or other shapes are possible. Stacking can be carried out to protect a column from floor to ceiling if desired.

To assure proper alignment of the pair of cushions when positioned back-to-back while surrounding a column, means such as projection 56, and recess 58 are molded into back 28 so as to nest when the cushions are properly aligned horizontally and vertically. Such means are not relied on to hold the cushions together, but are to provide for such alignment.

In the preferred embodiment, the cushions are symmetric about a horizontal center plane in order that two cushions of a single configuration will align when placed in back-to-back position and projection 56 will be present in position for insertion into recess 58 by simply rotating one of the cushions 180° if such projection is not present when initially placed back-to-back. Such arrangement is depicted in FIGS. 1–3 wherein end 30 of cushion 12 is adjacent end 32 of cushion 12' in order that a projection and a recess are present in position for nesting.

Cushion 12 of FIG. 4 has cavity 34 which is of a uniform cross-section, transverse to longitudinal axis 42, the full length of the cushion from end 30 to end 32. When fitted about a column, such as depicted in FIG. 1, having a rectangular cross-section, contact is generally made between the column and surfaces 36, 38, and 40 in their entirety. Such a contacting condition is contrasted with a second embodiment of the invention shown in FIG. 5. Cushion 60 of FIG. 5 has face 26, back 28 and ends 30 and 32; all portions of the cushion being the same as cushion 12 with the exception of a cavity 61 in back 28. Similar features of cushions 12 and 12' have the same reference number. Cavity 61 of back 28 which is adjacent end 30 is defined by surfaces 62, 64 and 66; adjacent end 32 by surfaces 68, 70 and 72; and at a portion of cavity 61 intermediate such end portions, by surfaces 74, 76 and 78. The portions of the cavity adjacent each end 30 and 32 are similar to one another and have a cross-section, transverse to longitudinal axis 80, which is the general shape of the cross-section of the column it is to surround. The cross-section of the portion of cavity 61 intermediate the end portions is dimensioned to provide a space between the column it is protecting and the cushion. Such space is preferably ¼ to 3 inches as measured perpendicular to the cavity surfaces. That is, for example, referring to FIG. 5, surface 76 is set back that distance from surfaces 64 and 70; and surface 74 is set back that distance from surfaces 62 and 68. Such cavity configuration provides for alignment of the cushions on the column by the end portions and provides space for flex and movement of the intermediate portion of the cushion during a collision to absorb some of the impact.

Figure 6:
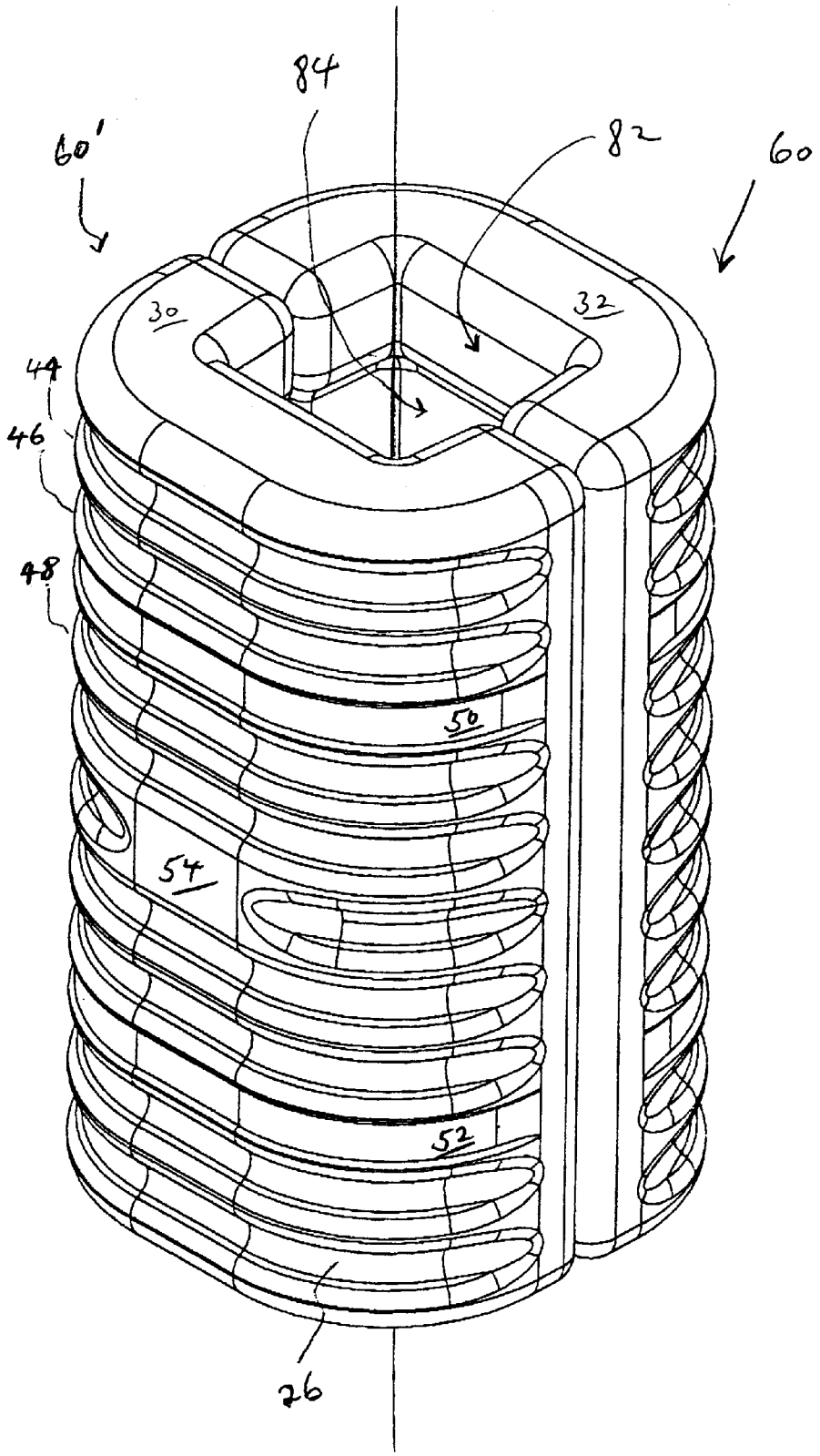
FIG. 6 is a perspective view of a pair of the cushions of FIG. 5 in back-to-back placement as when surrounding a column.

FIG. 6 depicts cushion 60 and matching cushion 60' in back-to-back position. The top end portion of cavity 61, which aligns the cushion on the column, is indicated at 82 and the intermediate portion of the cavity, providing the spacing, is indicated at 84.

Figure 5:
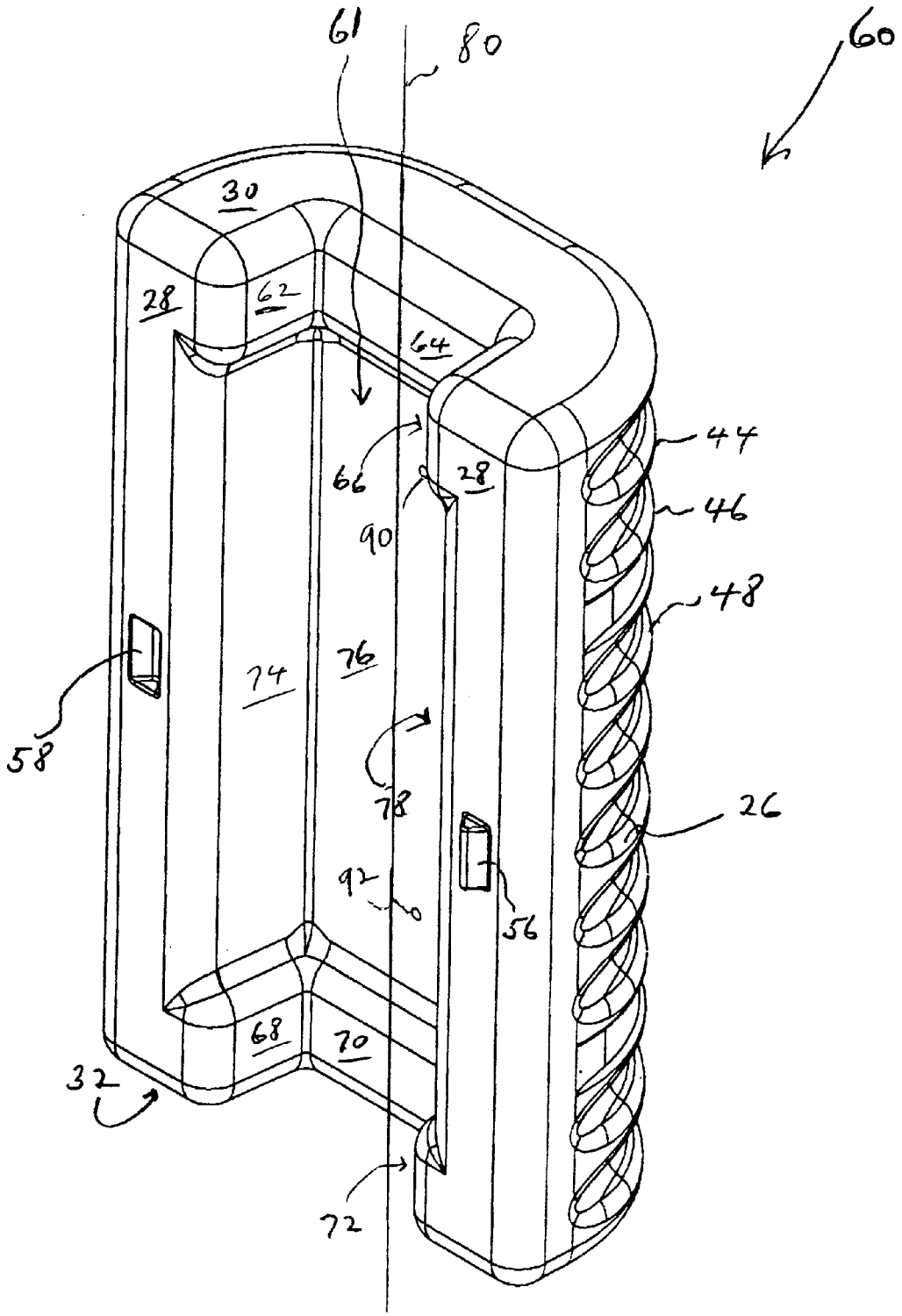
FIG. 5 is a perspective view of a cushion of a column protector of the invention having a cavity in its back varying in cross-section from end to end to provide space between the cushion and the column.

Referring to FIGS. 4 and 5, surface 38 has apertures 86 and 88; and surface 76 has apertures which are sealed, at 90 and 92. In a blow-molded plastic unit, apertures are present as a result of the molding process. Surface 38 of cushion 12 has such apertures remaining open; surface 76 of cushion 60 has such apertures sealed to provide a completely sealed unit. Either embodiment, that of FIG. 4 having a uniform cross-section cavity, or that of FIG. 5 having a varying cross-section cavity can have either apertures remaining open or have apertures which have been sealed. Cushions of the invention having sealed apertures provide a stiffer flexing action when collided with in comparison with cushions in which the apertures are open and in which air is free to be released during colliding impact.

Although the column protector of the invention is depicted in FIGS. 2 and 3 with a back having a cavity with a rectangular cross-section, transverse to the cushions longitudinal axis, and in use with columns having cross-sections other than rectangular, cavities with cross-sections "matching" the cross-sections of the column are not ruled out by the invention (for example, a circular cross-section for both the cavity and the column). A significant improvement in protection is not gained by such "matching" of cross sections. Also, use of cushions which provide a slightly "over-sized" cavity cross-section relative to the cross-section of the column being protected provides acceptable protection to the column. Practical considerations of available sizes and cavity shapes often make use of oversized and non-matching cavities necessary.

While specific materials, dimensional data, and processing steps have been set forth for purposes of describing embodiments of the invention, various modifications can be resorted to, in light of the above teachings, without departing from applicant's novel contributions; therefore, in determining the scope of the present invention, reference should be made to the appended claims.

What is claimed is:

1. An energy absorbing column protector, comprising a pair of elongated generally semi-cylindrically shaped hollow molded plastic cushions, each having:

a substantially planar back, a generally convex face, and opposed ends;

said back having a cavity therein extending from end-to-end to enable back-to-back placement of one said cushion with the other said cushion to encompass a column, said cavity having an end portion, adjacent each cushion end, having a cross-section, transverse to the longitudinal axis of the cushion, which is the general shape of the transverse cross-section of the column;

said convex face having horizontally extending corrugations, said substantially planar back having aligning means for mating with aligning means of the other cushion when in said back-to-back placement so as to provide alignment of the pair of cushions with each other in directions parallel to and transverse to said longitudinal axes.

2. An energy absorbing column protector according to claim 1, wherein the cavity of said back, intermediate the cavity end portions, has a cross-section, transverse to the longitudinal axis of the cushion, which provides a space between the column and the cushion when the cushions are in back-to-back placement encompassing the column, said space between the column and the cushion extending completely around the periphery of said transverse cross-section of the column.

3. An energy absorbing column protector according to claim 1, wherein the cavity of said back has a cross-section, transverse to the longitudinal axis of the cushion, which is the general shape of the transverse cross-section of the column, and extends uniformly from end to end.

4. An energy absorbing column protector according to claim 1, wherein said aligning means in each cushion back comprises at least one protrusion or at least one recess disposed and shaped such that when a pair of said cushions are placed back-to-back at least one protrusion nests in at least one recess to align the cushions vertically and horizontally with each other.

5. An energy absorbing column protector according to claim 1, further comprising at least one narrow horizontally oriented non-corrugated portion on the face of each cushion for positioning of cushion retaining means.

6. An energy absorbing column protector according to claim 1, wherein said opposed ends are substantially planar.

7. An energy absorbing column protector according to claim 1, wherein said horizontally extending corrugations in each cushion face have a depth of between ½ and 1½ inches.

8. An energy absorbing column protector according to claim 1, wherein intersections of the back, face, and end surfaces are rounded.

9. An energy absorbing column protector according to claim 1, further comprising at least one aperture in each cushion back.

10. An energy absorbing column protector according to claim 1, wherein the hollow molded plastic cushions have a wall thickness between ⅛ and ¼ inch.

11. An energy absorbing column protector according to claim 1, wherein the molded plastic is HDPE (High Density Polyethylene).

* * * * *